US006615982B1

(12) United States Patent
Stewart et al.

(10) Patent No.: US 6,615,982 B1
(45) Date of Patent: Sep. 9, 2003

(54) GOLF BAG

(75) Inventors: Roy Stewart, Poulton-le-Fylde (GB); Duncan Ross Stewart, Newent (GB)

(73) Assignee: Stewart Concepts Limited (GB)

( * ) Notice: Subject to any disclaimer, the term of this patent is extended or adjusted under 35 U.S.C. 154(b) by 0 days.

(21) Appl. No.: 10/031,015

(22) PCT Filed: Jul. 10, 2000

(86) PCT No.: PCT/GB00/02654

§ 371 (c)(1),
(2), (4) Date: Jan. 10, 2002

(87) PCT Pub. No.: WO01/03779

PCT Pub. Date: Jan. 18, 2001

(30) Foreign Application Priority Data

Jul. 13, 1999 (GB) ..... 99166334

(51) Int. Cl.[7] ..... A63B 55/06
(52) U.S. Cl. ..... 206/315.3; 206/315.6
(58) Field of Search ..... 206/315.3, 315.6, 206/315.7, 315.8, 315.2, 315.5; 248/96, 98; 211/70.2, 70.5, 60.1, 69.5; 280/DIG. 5, DIG. 6

(56) References Cited

U.S. PATENT DOCUMENTS

| | | | | |
|---|---|---|---|---|
| 2,890,061 A | | 6/1959 | Watson | |
| 3,425,708 A | | 2/1969 | Sato | |
| 3,948,332 A | * | 4/1976 | Tyner | 29/597 |
| 4,111,248 A | | 9/1978 | Leichhardt | |
| 4,750,617 A | | 6/1988 | Anderson et al. | |
| 4,852,896 A | * | 8/1989 | Mills | 280/47.18 |
| 4,915,221 A | | 4/1990 | Spangler | |
| 5,590,772 A | * | 1/1997 | Schuhlen et al. | 206/315.3 |
| 5,918,490 A | * | 7/1999 | Lion | 70/58 |
| 6,217,042 B1 | * | 4/2001 | Kurtz et al. | 280/37 |
| 6,298,987 B1 | * | 10/2001 | Clark | 206/315.6 |

FOREIGN PATENT DOCUMENTS

| | | |
|---|---|---|
| AU | 4413479 A | 8/1980 |
| DE | 3714066 A1 | 2/1988 |
| GB | 2275658 A | 9/1994 |
| WO | WO 84/03638 | 9/1984 |

* cited by examiner

*Primary Examiner*—Lee Young
*Assistant Examiner*—Lien Ngo
(74) *Attorney, Agent, or Firm*—Samuels, Gauthier & Stevens

(57) ABSTRACT

A golf bag for storing and carrying a standard set of (14) golf clubs and ancillary golf equipment and comprising a tubular housing (11, 12, 13, 14) in which is rotatably mounted a carousel (16, 17, 19) rotatable in upper and lower bearings within the housing. On the carousel clubs are mounted with their heads lowermost on a plurality of shelves (18) with their shafts located by clips (21) in individual flutes (20) in the carousel. The clubs are maintained in position within the housing and prevented from moving or clashing together. Access to the interior of the housing is by way of a hinged door (15), and the interior of the carousel provides a storage compartment. Housing the clubs with their heads lowermost lowers the centre of gravity of the bag, and a detachable carriage (38,39) and optional tractor unit (42) are provided.

17 Claims, 5 Drawing Sheets

GOLF BAG

THIS INVENTION concerns a golf bag being a container for the storage and carrying of a standard set of 14 golf clubs, and which serves also for storage and transportation. The bag may be carried, or act as a manual or powered trolley. The bag is designed to be weather and damage-resistant thus to protect the clubs and ancillary golf equipment in use, storage and transportation.

Golf bags are known in which the clubs are retained in discrete locations to prevent them from clashing during movement of the bag thus to protect the clubs from damage. U.S. Pat. No. 2,890,061 describes and illustrates a golf club container comprising a carrousel mounted for rotation within a fixed housing and adapted to accommodate at spaced locations around the carrousel a set of golf clubs. An access opening is provided along the length of the housing to enable individual clubs to be removed from and replaced on the carrousel. The club heads are accommodated on a pair of vertically displaced shelves but are not prevented from clashing with one another during transportation, nor are they prevented from rising within the housing and from the risk of becoming dislodged from the shelves.

U.S. Pat. No. 3,425,708 describes and illustrates a golf trolley comprising a carrousel rotatably mounted within a fixed housing and having a plurality of flat-bottomed, dished shelves upon which club heads are located. Again, there is a vertical access opening through which clubs may be removed from and replaced on the carrousel. However, no positive means is provided to prevent the club heads from rotating about their respective shafts nor from rising within the bag. Thus there remains the risk of club heads clashing and becoming damaged during movement of the trolley.

A principal object of the present invention is to provide a golf bag in which the clubs are stored on a carousel with their heads lowermost and the grips at a generally common level for easy retrieval and in which the clubs are individually protects along their entire length.

According to the present invention there is provided a golf bag comprising a tubular housing, a carrousel rotatably mounted within the housing, shelves mounted on the carrousel to support club heads at two or more levels in a lower region of the bag, and to accommodate a set of golf clubs in discrete locations on and around the carrousel, an elongate access opening in the wall of the housing through which a selected club may pass, and a closure means for the opening; characterised in that the carrousel includes means to prevent the clubs from rotating about their respective shafts and to prevent the clubs from rising within the bag.

At least one of the shelves may be inclined downwardly towards the rotational axis of the carousel.

The shelves may be dished in inverted conical form.

Three or more shelves may be mounted on a central spindle in a lower region of the carousel in axially spaced locations thereon.

The shelves may be of a flexible material.

The spindle may be located in a lower bearing in the base of the housing.

The carousel may have an internal storage compartment and an upper bearing member bearing upon the internal wall of the housing.

The carousel may be formed with flutes to accommodate individual club shafts and grips.

Clips may be included to retain the club shafts and grips and may be adjustable relative to the shelves.

The clips may include means to prevent the clubs from rising in the bag.

The bag may include attachment means for trolley wheels which may be retractable.

A wheeled transportation tray may be provided and adapted to receive the bag in clamped and locked relationship thereon.

An embodiment of the invention will now be described by way of example only, with reference to the accompanying drawings in which.

Figure 1:
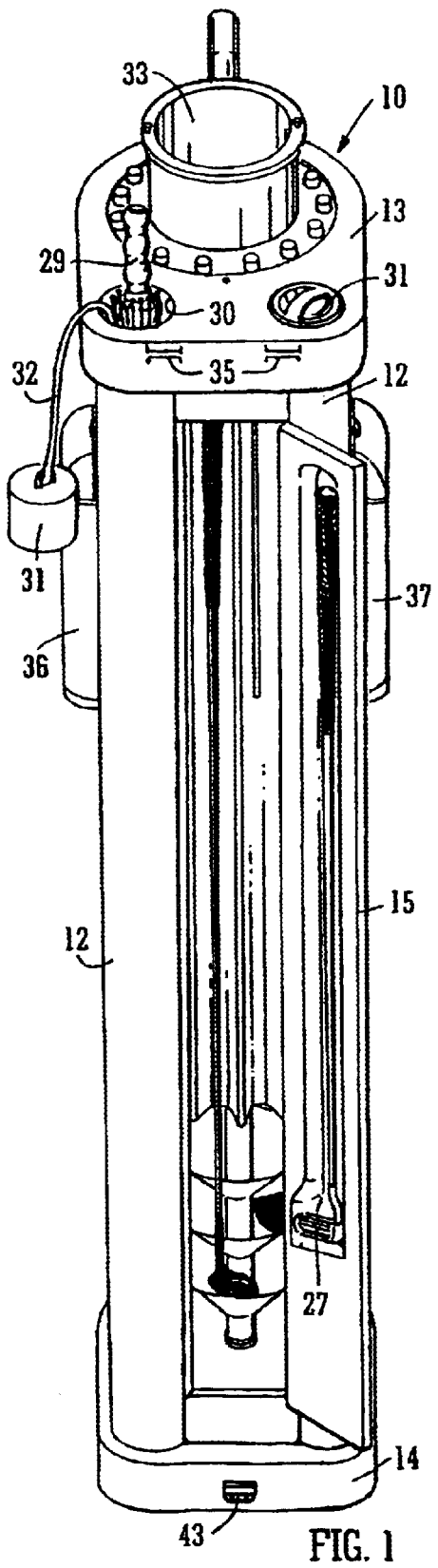
FIG. 1 is a perspective view of a golf bag made in accordance with the invention.
Figure 2:
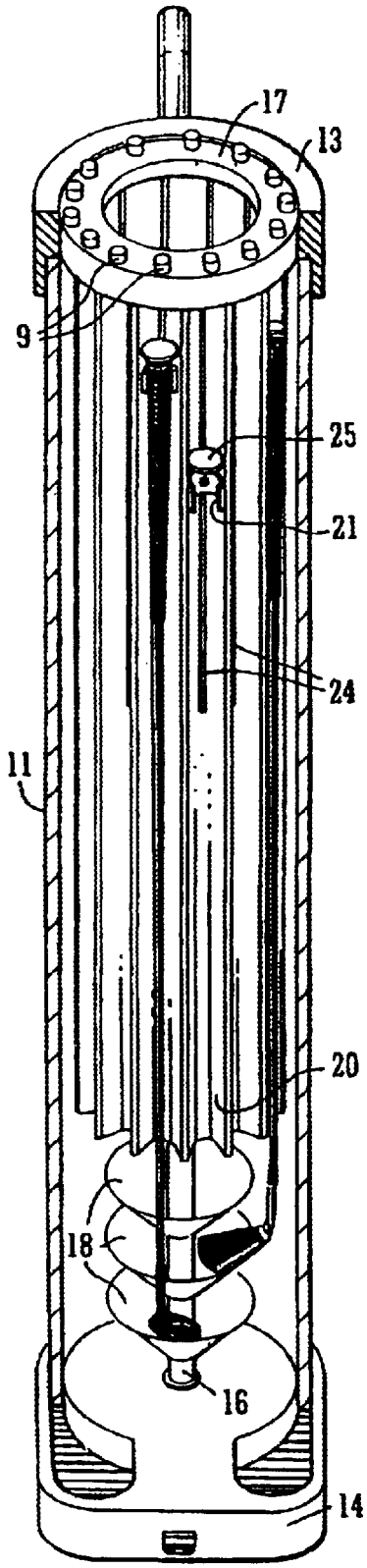
FIG. 2 is a similar view with parts removed for internal illustration.
Figure 3:
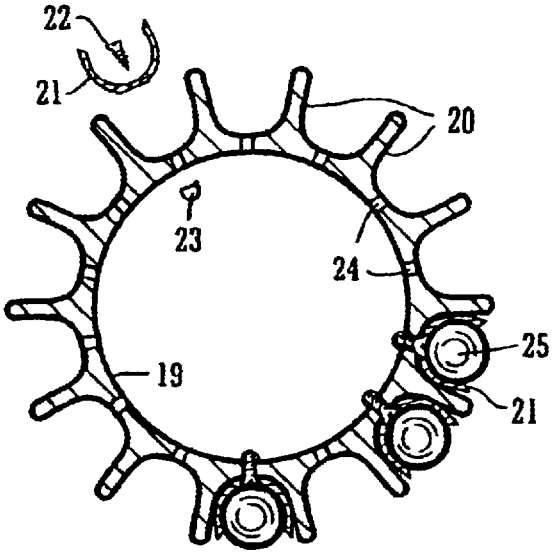
FIG. 3 is a horizontal section showing a part of the bag.

Referring now to FIGS. 1 and 2 the bag is illustrated generally at 10 and comprises an outer tubular wall 11 formed from a rigid plastics material turned to provide a pair of parallel spaced tubular portions 12 and completed by top and bottom plastics mouldings or 13 and 14. The wall 11 and caps 13 and 14 may be bonded together or attached mechanically, for example, by screws.

The top and bottom caps 13 and 14 include recesses to serve as trunnions for the mounting of a hinged door 15 which is lockable and thus provides access to the interior of the bag for the inert ion and retrieval of golf clubs.

Rotatably mounted in a central bearing in the bottom cap 14 is a carousel having a central lower spindle 16 and an upper annular bearing member 17.

Mounted on the spindle 16 in the lower region of the bag at axially spaced locations thereon are three inverted conical shelves 18. Above tie uppermost shelf 18 the carousel widens into a cylindrical portion 19, the outer wall of which is fluted as at 20. The flutes extend from the top of the carousel to a position close to but spaced above the uppermost of the shelf 18.

As can be seen from FIGS. 1 and 2, golf clubs may be located with their heads lowermost on the shelves 18 and the shafts and grips within the fluted formation of the cylindrical portion 19. Adjustably fixed within each flute 20 is a clip 21 having an adjustment screw 22 and nut 23. The valley of each flute 20 is slotted as at 24 to provide vertical adjustment of the position of the clip 21, i.e. relative to the bottom of the carousel and the shelves 18.

Each clip 21 includes an overhang 25 which, together with the associated shelf 18 retains a club in a fixed vertical disposition and, by preventing the club from rising keeps it securely in position.

Figure 6:
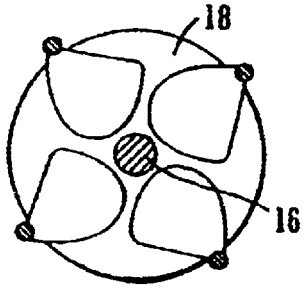
FIGS. 5 and 6 illustrate, schematically, the arrangement of the heads of several golf clubs located within the bag.
Figure 5:
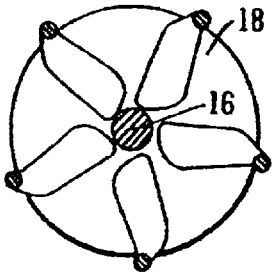

FIG. 5 illustrates how five "irons" may be located on one of the shelves 18 with the shafts outermost, and FIG. 6 illustrates how four "woods" may be similarly housed. It will be seen that the clubs are prevented from movement in that for the clues to turn they must "climb out" of the dished shelves and since the overhang 25 of the associated clip 21 prevents this the club is held securely in position. If desirable, the material of the shelves may be somewhat flexible thus to be partially deformed by the weight of the club which thus further prevents the club head from rotating about its shaft.

Figure 4:
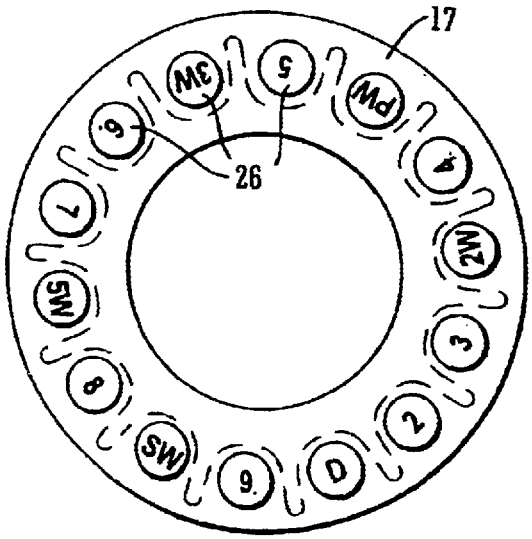
FIG. 4 is a plan view of a part of the bag.

A full set of woods and irons may be housed on the carousel with the longer clubs located on the bottom shelf and the shorter clubs located on shelves thereabove so that the tops of the grips may be found in a generally common region towards the top of the carousel. When a user initially sets up the bag, the clips 21 will be adjusted and dedicated each to a particular club. Around the peripheral region of the upper face of annular bearing member 17 there are a number of pegs 9 which serve partly for rotation of the carousel and also to accommodate an identity disc such as is illustrated at 26 in FIG. 4 so that the user may rotate the carousel to locate a desired club in a position adjacent the door 15 for retrieval.

A putter 27, being a much shorter club, is conveniently housed within a recess 28 in the door 15.

The tubular parts 12 of the wall 11 of the bag serve to accommodate, an umbrella 29 and, for example, a ball retriever (not shown). The top cap 13 is apertured at 30 to receive these items and closed by a removable weather resistant plug 31. A tie 32 attached to each plug 31 extends to a slider (not shown) in each of the tubes to raise the contained item for easy retrieval.

The central bore of the cylindrical portion 19 of the carousel may accommodate such items as additional clothing, and one or more small removable containers 33 may be located in the upper region of this space to accommodate small items such as tees, car keys etc.

The whole of the upper end of the bag may be closed by a hinged lid 34 (see FIG. 7) attached at 35 to the top cap 13 of the bag. The lid may accommodate a score card and pencil on its underside. Panniers 36 and 37 may be removably attached to the sides of the bag for additional storage.

Figure 7:
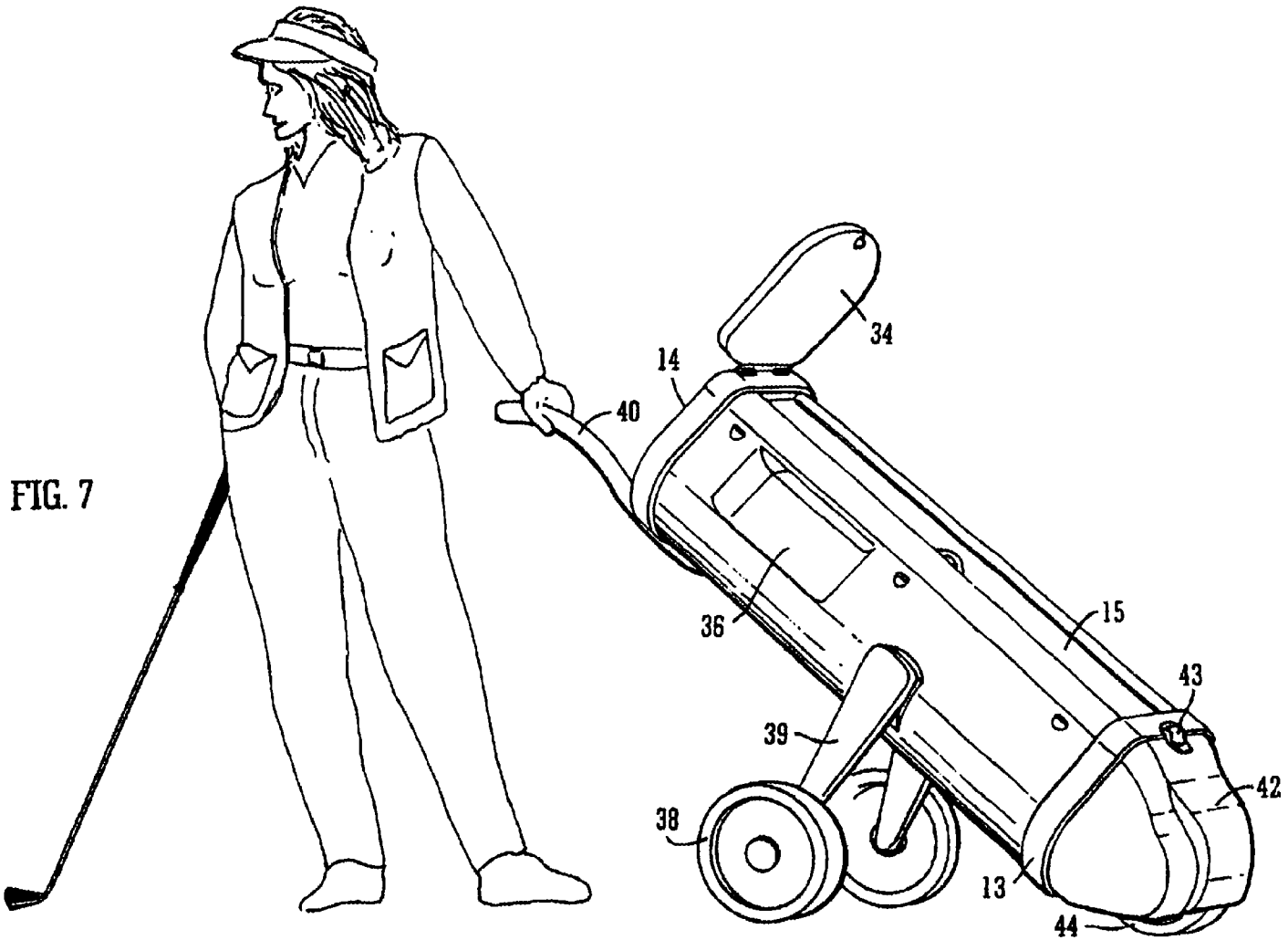
FIG. 7 illustrates the bag in use with a trolley and tractor unit.

As can be seen from FIG. 7 trolley wheels 38 on pivotal legs 39 are retractably attached to the sides of the bag where they can be moved into a stowed position alongside the bag, or removed entirely therefrom, when not required.

Figure 8:
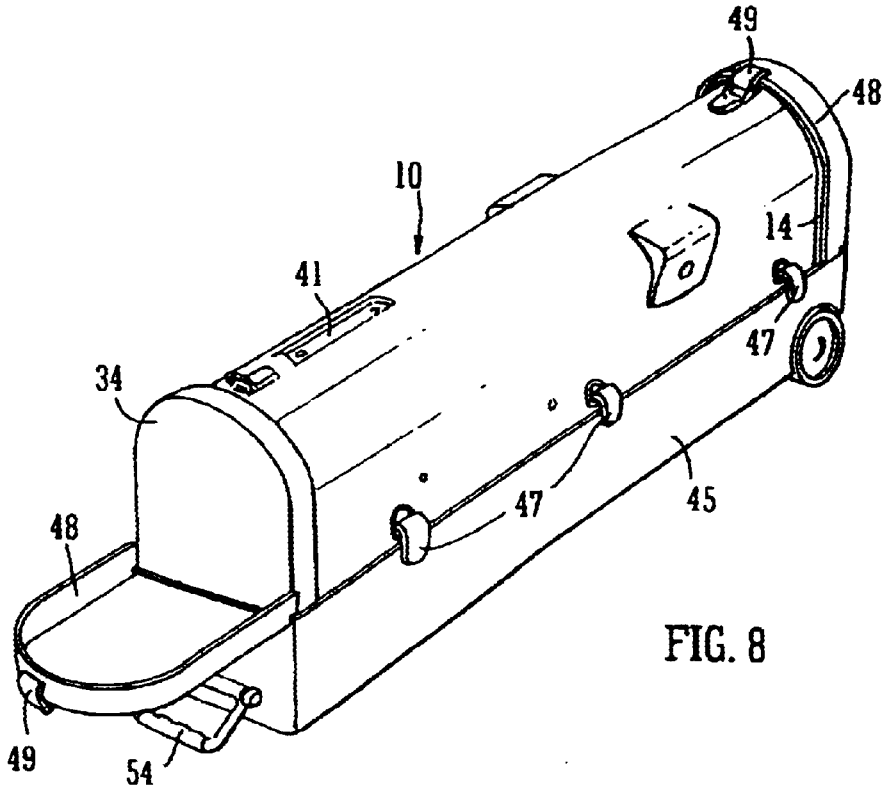
FIG. 8 illustrates a transportation tray for the bag.

When the trolley is in use an operating handle 40 is removably attached to the upper region of the bag at a position illustrated at 41 in FIG. 8.

FIG. 7 also illustrates the attachment of a tractor unit 42 which contains a drive motor with gear box and control unit as well as a battery. The tractor unit is clamped as at 43 to the bottom cap 14 of the bag and thus provides a driven wheel 44 which forms, with the wheels 38, a motorised carriage.

It will be seen that the shape of the bag is such that the wall is curved to provide a trough on the side which will be lowermost when it is used as illustrated in FIG. 7, and drain apertures are provided in the base of the bag/tractor unit to enable water from wet clubs to drain readily from the lowermost region of the bag. Similarly, by opening the door 15 the user may hose down the club head within the bag which is thus automatically drained.

Figure 9:
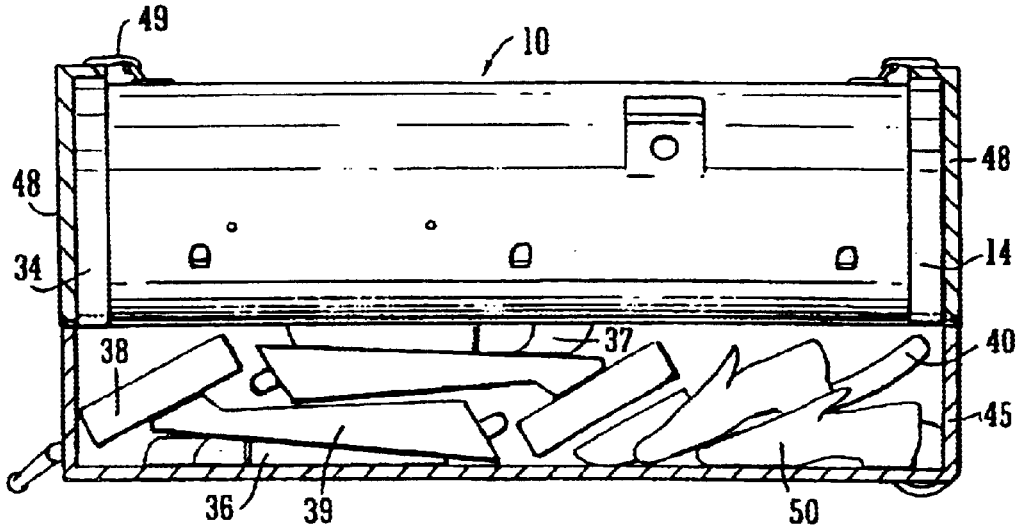
FIG. 9 is a partial vertical section through the tray and bag of FIG. 8 illustrating the housing of certain ancillary items.

Referring now to FIG. 8, as an accessory to the bag here is provided a box-like transportation tray 45 having a pair of wheels 46 at one end and a pull-handle 54 at the other. For use of the tray, the bag 10 is located thereon with the door lowermost and attached by clamps 47 along the sides of the tray 45, and a pair of hinged flaps 48 also clamped at 49, at the ends of the tray. Thus, the bag is safely housed for transportation and as can be seen in FIG. 9 there is space within the tray 45 beneath the bag 10 for the containment of the wheels 38 and legs 39, the handle 40 and additional equipment or accessories such as golf shoes 50.

Figure 10:
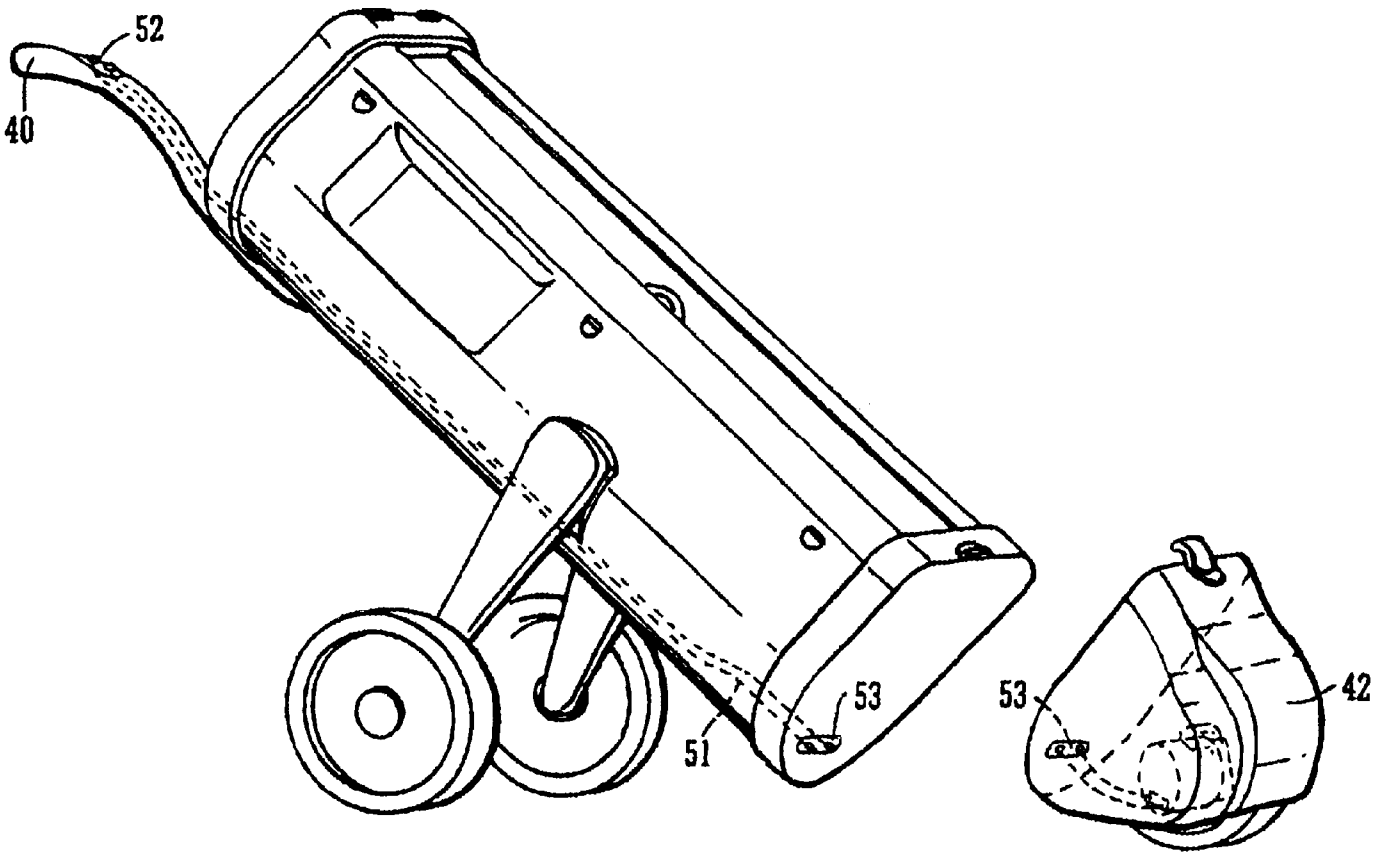
FIG. 10 is a view similar to FIG. 7 illustrating electrical circuitry within the bag.

As can be seen in FIG. 10, electrical conductors 51 are housed within the wall of the bag and extend between the control unit of the tractor unit 42 and switches 52 on the operating handle 40 whereby the user may control operation of the tractor unit. Suitable jack plug and socket connectors 53 are provided on the various units to complete the control circuit.

While the design of the bag is such that the clubs are well protected in their containment, for additional protection, particularly during transportaton, a plurality of resilient strips, for example of foamed polyurethane may be introduced at the door 15 and wound around the carousel by rotation thereof to occupy any free space between the club shafts on the carousel, and the wall 11 of the bag. In this way, the shafts are held snugly within their flutes with the door closed and locked. Reverse rotation of the carousel provides easy removal of the strips when required.

Certain clear advantages accrue from a golf bag made in accordance with the invention. For example, with the club heads located in the lower region of the bag the centre of gravity thereof is lowered which in turn enables the wheels 38 of the trolley to be positioned closer together and also prevents the bag from tipping when disposed at a shallower angle with respect to the ground.

Also, with the club heads lowermost any water remaining thereon may drain away without tracking along the shafts. Thus, the grips are kept dry.

Each of the dishes 18 is available for receiving a club head at any position around its periphery i.e. there are no radial walls dividing the shelves into compartments. Thus, flexibility of choice of clubs, and where to position them, is maximised.

It is not intended to limit the invention to the examples described and illustrated herein. For example, in place of the flutes 20 a further set of clips 21 may be provided in the lower region of the carousel above the shelves whereby the grips and shafts are retained and prevented from lateral movement.

Additional panniers or other ancillary equipment may be removably attached to the outer wall of the bag by clips or by press studs or the like and, in place of or in addition to the wheeled carriage 38, 39, a carrying harness may be adjustably attached for use when trolleys are not permitted on the course. Similarly, a hinged stand may be attached in place of or in addition to the wheeled trolley which is deployed when the bag is placed upon the ground. The rigid construction of the bag enables all of these items to be readily attachable at predetermined locations upon the outer wall surface.

It will be appreciated that a golf bag made in accordance with this invention can be provided in modular form with many dedicated accessories attachable thereto. The wall 11 may have a decorative textured or coloured outer appearance to suit individual tastes.

What is claimed is:

1. A golf bag comprising a tubular housing, a carrousel rotatably mounted within the housing, shelves mounted on the carrousel to support club heads at two or more levels in a lower region of the bag, and to accommodate a set of golf clubs in discrete locations on and around the carrousel, an elongate access opening in the wall of the housing through which a selected club may pass, and a closure means for the opening; characterised in that the carrousel includes means to prevent the clubs from rotating about their respective shafts and to prevent the clubs from rising within the bags including clips to retain the club shafts and grips, the clips being adjustable relative to the shelves.

2. A golf bag according to claim 1, wherein at least one of the shelves is inclined downwardly towards the rotational axis of the carousel.

3. A golf bag according to claim 1, wherein the shelves are dished in inverted conical form.

4. A golf bag according to claim 1, including three or more shelves mounted on a central spindle in a lower region of the carrousel in axially spaced locations thereon.

5. A golf bag according to claim 1, in which the shelves are of a flexible material.

6. A golf bag according to claim 4, wherein the spindle is located in a lower bearing in the base of the housing.

7. A golf bag according to claim 1, wherein the carrousel has an upper bearing member bearing upon the internal wall of the housing.

8. A golf bag according to claim 1, wherein the carrousel is formed with flutes to accommodate individual club shafts and grips.

9. A golf bag according to claim 1, including attachment means for retractable or removable trolley wheels.

10. A golf bag according to claim 1, including an accessory of a wheeled transportation tray with means to receive the bag in clamped and locked relationship thereon.

11. A golf bag according to claim 1, including, on the carrousel, visual means to identify the positions of particular clubs within the bag.

12. A golf bag according to claim 1, having means for attachment thereto of a motorized tractor unit.

13. A golf bag according to claim 11, including electrical conductors within the bag and connectors for connection of the conductors to a control unit within a tractor unit, and with operator switches on a removable handle to be located at the top of the bag.

14. A golf bag according to claim 1, wherein the carrousel includes an internal compartment for the containment of clothing or accessories.

15. A golf bag according to claim 1, wherein the tubular housing includes at least one tubular space for accommodating an elongate member such as an umbrella.

16. A golf bag according to claim 1, in which the tubular housing includes means for, and is shaped to enable, drainage of water from the bottom interior thereof.

17. A golf bag according to claim 1, wherein the means to prevent the clubs from rotating and rising in the bag includes a set of clips to retain the grips of the clubs, the clips being adjustable in height relative to the shelves, and each clip includes an overhang to retain an associated club in a fixed vertical disposition.

* * * * *